US006782715B2

(12) United States Patent
Ruth

(10) Patent No.: US 6,782,715 B2
(45) Date of Patent: Aug. 31, 2004

(54) GEMSTONE ARRANGEMENT

(76) Inventor: Gregg Ruth, 3868 Cross Creek Rd., Malibu, CA (US) 90265

( * ) Notice: Subject to any disclaimer, the term of this patent is extended or adjusted under 35 U.S.C. 154(b) by 0 days.

(21) Appl. No.: 10/286,268

(22) Filed: Nov. 1, 2002

(65) Prior Publication Data

US 2004/0083757 A1 May 6, 2004

(51) Int. Cl.[7] ..... A44C 17/02
(52) U.S. Cl. ..... 63/26; 63/27; 63/28
(58) Field of Search ..... 63/26, 27, 28; D11/91, 92

(56) References Cited

U.S. PATENT DOCUMENTS

| | | | | | |
|---|---|---|---|---|---|
| 802,267 | A | * | 10/1905 | Chaumet | 63/28 |
| 1,818,324 | A | | 8/1931 | Hamin | |
| 2,207,869 | A | | 7/1940 | Monnier | |
| D143,988 | S | * | 2/1946 | Pennino | D11/86 |
| 2,835,117 | A | | 5/1958 | Lutrario | |
| 2,907,187 | A | | 10/1959 | Karp et al. | |
| 3,483,716 | A | | 12/1969 | Stenzler | |
| 4,936,115 | A | * | 6/1990 | Mesica | 63/26 |
| 5,099,660 | A | * | 3/1992 | Dostourian | 63/28 |
| 5,488,839 | A | * | 2/1996 | Udko | 63/28 |
| 5,560,224 | A | | 10/1996 | Tessler | |
| 5,664,440 | A | * | 9/1997 | Roemer | 63/15 |
| 6,007,907 | A | | 12/1999 | Wolf | |
| 6,012,302 | A | | 1/2000 | Hurwitz et al. | |
| D438,138 | S | | 2/2001 | Chan | |
| D443,554 | S | | 6/2001 | Lai | |
| D445,355 | S | * | 7/2001 | Lai | D11/91 |
| 6,293,129 | B1 | | 9/2001 | Gurevich | |
| 6,298,689 | B1 | | 10/2001 | Lai | |
| D453,706 | S | * | 2/2002 | Lai | D11/91 |
| 2002/0178750 | A1 | * | 12/2002 | Pinto | 63/26 |

FOREIGN PATENT DOCUMENTS

| | | | | |
|---|---|---|---|---|
| DE | 170473 | * | 8/1951 | 63/26 |
| GB | 634227 | * | 3/1950 | 63/28 |

* cited by examiner

*Primary Examiner*—William L. Miller
*Assistant Examiner*—Dinesh Melwani
(74) *Attorney, Agent, or Firm*—Stephen E. Feldman, PC

(57) ABSTRACT

A gemstone arrangement is described including a primary gem and at least one complementary gem. The primary gem includes a crown and a pavilion. The pavilion has an external wall defining an outer surface. The complementary gem has a crown defining a table. The table is in juxtaposition to and aligned with the pavilion wall for the maximum passage of ambient light from the complementary gem into the primary gem to enhance its visual appearance. In addition, the complementary gem can be positioned and aligned to receive light losses from a primary gem and return those light losses through the crown of the complementary gem.

2 Claims, 2 Drawing Sheets

GEMSTONE ARRANGEMENT

BACKGROUND

1. Technical Field

The present disclosure relates to arrangements for gemstones. More particularly, the present disclosure relates to arrangements of gemstones that enhance their visual characteristics.

2. Background of Related Art

Gem arrangements seek to enhance the appearance of the gems by making them appear larger and/or enhance their visual characteristics. This is often done by abutting the gems such that many smaller gems appear to be a single larger and more valuable gem often known as a composite stone. Different mountain systems can further enhance the simulated appearance of composite gems by their lack of visibility. Alternatively, gems can be arranged to reflect or refract light in a complementary manner such that light further enhances the natural beauty of the arrangement. Complementary arrangements position a plurality of complementary gems in relation to a central gem such that the refracted light from the complementary gems is at least partially introduced into and benefits the central gem.

An article of jewelry is described in U.S. Pat. No. 1,818,324 to Hamin. The arrangement includes a central stone encircled or surrounded by a series of smaller stones. The invention is focused generally on an economical process wherein the encircling stones are set in a single operation. The tables of the encircling stones arc shown approximately parallel with the crown angle. Thus, while the central stone and encircling stones of Hamin are in close proximity, the stones lack a complimentary arrangement wherein the encircling stones provide visually enhancing benefits to the central stone.

In U.S. Pat. No. 2,207,869 to Monnier, a composite precious stone is shown including a rectangular center stone surrounded by four trapezoidal stones to form a larger rectangular stone. Alternatively a step-cut center stone is surrounded by eight smaller composite stones. Monnier focuses on the fitting of the stones and the concealment of the mounting, but the composite stones are not positioned in a complimentary arrangement wherein the smaller composite stones provide visually enhancing benefits to the central stone.

A complex article of jewelry is described in U.S. Pat. No. 4,936,115 to Mesica comprising a central gem, complementary gemstones at least partially surrounding the central gem, and a setting for the central gem and complementary gemstones. The complementary gemstones are elongate gemstones each defining a separate longitudinal axis. Each complementary gemstone has two diverging angled faces forming an edge oriented inwards towards the central gems. The complementary gemstones are contiguously mounted forming an enclosure proximate to and positioning at least a portion of the faces to the pavilion of the central gem.

Mesica teaches at least a portion of the light passing inward through the mounted complementary gemstones is refracted and enters into the central gem and this refracted light can greatly enhance the appearance of the central gem. However, in order to achieve this stated enhancement, Mesica mandates many specific limitations on the article of jewelry to get these effects. For example, Mesica requires the typical complementary gemstones to be baguette, tapered baguette, square and round. In contrast, the central gemstone is typically round, marquise, square, pea, emerald cut or princess shapes. The complementary gemstones are preferably in sizes from about 3 mm and up in length along their longitudinal axes and contiguously mounted. Finally, Mesica requires the length of complementary gemstones to be substantially the same to within at least about a thousandth of an inch in order to be held securely in the mounting at their top and bottom.

While Mesica teaches an enhanced appearance of the central gem, Mesica defines many "typical" and "preferred" constraints on the shape of the complementary gemstones including the minimal length, substantially same length, and contiguous positioning. Thus, Mesica has defined multiple constraints that increase the complexity of the mounting of the complementary gemstones while creating a marginal visual improvement to the central gem. For example, while the complementary gemstones are in close proximity to the central gemstone, their general alignment is not primarily directed towards the central gem, but towards a portion of the mounting and thus the ability of the complementary stones to provide an appreciable amount of light at angles suitable for rays of light to pass into the central gem is questionable.

Referring now to U.S. Pat. No. 6,289,689 B1 and D443,554 S to Lai, jewelry settings are taught including mounting systems for arrangements of square or rectangular gemstones set to substantially appear as a single large gemstone. A lattice type mounting is employed to support the positioning of multiple smaller gemstones creating the appearance of a single truncated pyramidal shaped gemstone having either a square or rectangular base. The positioning of the gemstones in Lai, however, does not produce a complimentary arrangement of gemstones wherein visually enhancing benefits are created between the gemstones.

A continuing need exists for a simplified gemstone arrangement having visually enhancing characteristics for the central gemstone that does not have complex requirements for the positioning, type, and dimensions of the complementary gemstones.

SUMMARY

A gemstone arrangement is described including a primary gem and at least one complementary gem. The primary gem has a crown and a pavilion. Each complementary gem has a table and a pavilion. The table of the complementary gem is in juxtaposition with and parallel to a portion of the pavilion of the primary gem. The primary gem and complementary gems are preferably brilliant cut diamonds.

The invention, together with attendant advantages, will be best understood by reference to the following detailed description of the invention when used in conjunction with the figures below.

BRIEF DESCRIPTION OF THE DRAWINGS

Preferred embodiments of the presently disclosed gemstone arrangement arc described herein with reference to the drawings, wherein.

DETAILED DESCRIPTION OF THE EMBODIMENTS

Figure 1:
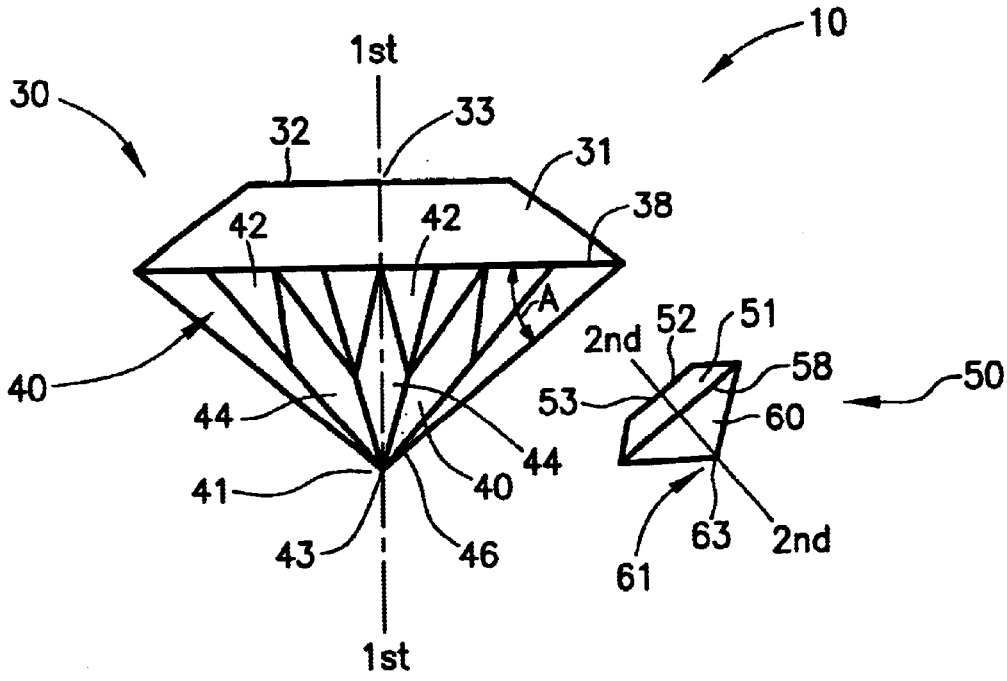
FIG. 1 is side view of one preferred embodiment of a gemstone arrangement constructed in accordance with the present disclosure.

Referring now in specific detail to the drawings in which like referenced numerals identify similar or identical elements throughout the several views, and initially to FIG. 1, a novel gemstone arrangement 10 is shown including a primary gemstone 30 and at least one complementary gemstone 50. Primary gemstone 30 is preferably a brilliant cut diamond in this one preferred embodiment, but can be any suitable cut of gemstone, such as but not limited to a marquise, oval, emerald cut, pear, trillion, princess, or other specialty cuts. Complementary gemstone 50 is preferably a brilliant cut diamond, but can be an emerald cut or trillion, for example.

Primary gemstone 30 has a crown 31, a table 32, a girdle 38, and a pavilion 40. Table 32 has a center 33 that in combination with a center 43 of pavilion 40, defines a first longitudinal axis. Table 32 is flat and defines a first plane. Pavilion 40 has a plurality of lower girdle facets 42 and pavilion facets 44. A pavil angle-A is defined between a first plane defined by girdle 38 and an external wall 46 of pavilion 40. Pavilion 40 defines a cult 41.

Each complementary gemstone 50 has a crown 51, a table 52, a girdle 58, and a pavilion 60. Table 52 has a center 53 that in combination with a center 63 of pavilion 60, defines a second longitudinal axis. Table 52 defines a second plane. Each complementary gem 50 is preferably positioned such that table 52 is approximately parallel to external wall 46 or pavil angle-A of primary gem 30. Pavilion 60 defines a culet 61.

The sizes shown of primary gem 30 and complementary gem 50 are representative and advantageously shown to aid in the description of gemstone arrangement 10. Thus, for example, in one preferred embodiment, the ratio of sizes of gem 30 to gems 50 can vary from a range of approximately two to one to approximately twenty-five to one.

The size of the tables of the primary gem and complimentary gems affects their appearance. For example, the larger the size of the table, the greater the brilliance or sparkle of the diamond, but this produces a corresponding reduction in the fire of the diamond. The brilliance of the diamond results from its very bright and smooth surface for reflection in combination with its high refractive index. Diamonds are cut in a manner such that when a viewer is looking at the crown/table, the light entering the diamond through the table/crown is reflected within the diamond by the pavilion's facets and exits through facets on the crown or the table for the benefit of the viewer. Fire describes the ability of the diamond to act as a prism and disperse white light into its colors. Fire is evaluated by the intensity and variety of color. Preferred table dimensions for brilliant stones are between 53% and 57.5% of the width of the gem.

Figure 2:
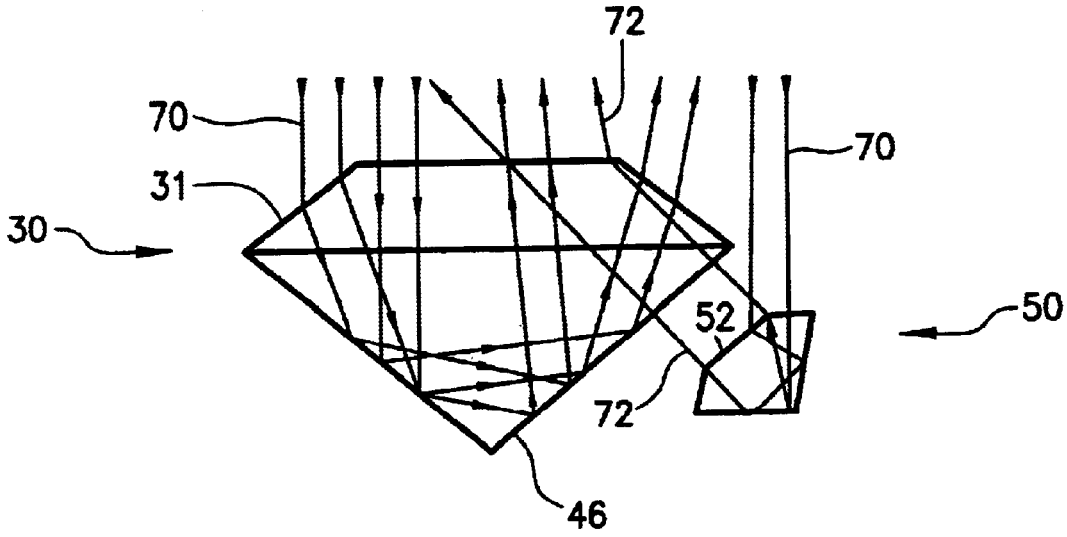
FIG. 2 is a cross-sectional side view of the gemstone arrangement of FIG. 1 showing light from one complementary gem passing into the primary gemstone in accordance with the present disclosure.

Referring now to FIG. 2, light 70 is shown as idealized parallel rays, generally aligned with the first longitudinal axis, entering brilliant cut primary gem 30 through crown 31. In this one example light 70 reflects through the interior of gem 30 before exiting out through crown 31. When cut within preferred guidelines, the brilliant cut diamond has aligned crown and pavilion facets, an overall symmetry, and a fine highly reflective finish configured to return the maximum amount of reflected light 70 from within the gem.

As shown, complementary gem 50 is positioned with table 52 in juxtaposition with and approximately parallel to external wall 46 of primary gem 30. In addition, table 52 can be selectively aligned with one lower girdle facet 42 or one pavilion facet 44. This would ensure a greater percentile of light 72 passing through table 52 would be passed into primary gem 30. Alternative embodiments are envisioned to include, for example, a range of alignments of table 52 along the length of external wall 46 from girdle 38 to culet 43 that encompasses the full range of diamond cuts of primary gem 30.

This arrangement of primary gem 30 and complementary gem 50 infuses primary gem 30 with ambient light 70 not only from the traditional areas of crown 31, but also from the passage of light 72 from ambient sources through complementary gem 50. This additional light 72 passing through complementary gem 50 and refracting into primary gem 30 can noticeably enhance the brilliance and fire already present in the primary gem.

Further, as one example, as a result of the dimensional cuts of gem 30 the light emanating from 32 favor sparkle over fire. The at least one complementary gem 50 is dimensionally cut to favor fire over sparkle and thus primary gem 30 can advantageously receive refracted light having favorable fire from one or more of the complimentary gems. Thus, it is advantageously possible to complement through balance of heighten selected characteristics by combining the refracted light of complimentary gems 50 into primary gem 30.

Figure 3:
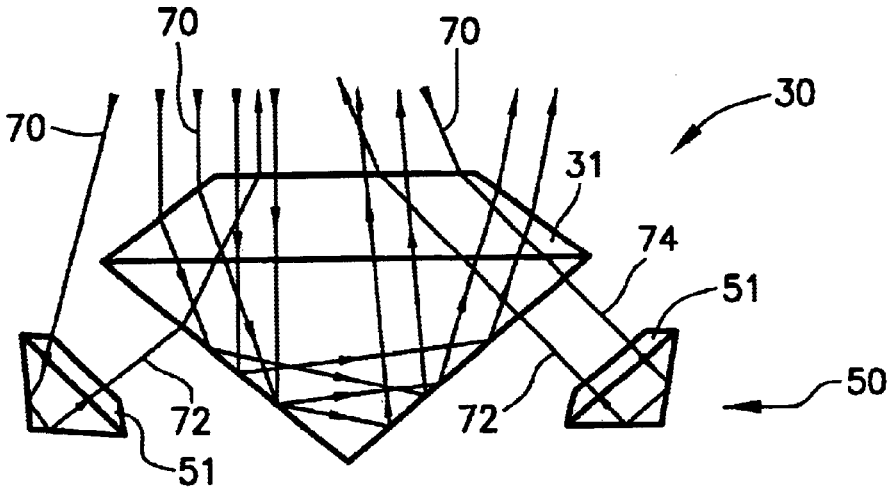
FIG. 3 is the cross-sectional side view of the gemstone arrangement of FIG. 2 further including a second complementary gem additionally showing light from the primary gem passing into one of the complementary gems and the light being returned to the primary gem by the complementary gem in accordance with the present disclosure.

As shown in FIG. 3, in reality, natural white light 70 does not have uniform approximately parallel rays and diamonds are not perfectly manufactured. Natural white light can enter crown 31, for example, at any angle either as direct or reflected light 70. Similarly, diamonds come in a wide variety of shapes each having unique and differing optical properties which are vulnerable to unplanned leakages of light or losses 74. Losses 74 occur due to the non-uniformity or randomness of natural light 70, type of diamond, manufacturing of the diamond outside of the preferred guidelines, imperfections within the diamond, and flaws in the surface finish, for example.

In this one preferred alternate embodiment, complementary gems 50 are positioned and aligned to receive light 74 passing through primary gem 30 and to return at least a portion of light 74 as complementary light 72 from complementary gems 50 to primary gem 30. Thus, complementary gems 50 provide means for increasing the amount of ambient light 70 passing through primary gem 30 by the positioning of complementary gems 50 to pass ambient light 70 through crowns 51 into primary gem 30 and/or returning at least a portion of light toss 74 from primary gem 30 through crowns 51 of complementary gem 50 as complementary light 72. The preferred brilliant cut is configured to maximize the amount of light exiting through crowns 31 and 51.

As one example of an alternate embodiment, oval and marquise cuts are vulnerable to a bow tie or darkening of their center as a result of light losses 74 due to a less than optimal cut. Thus, it is envisioned that one or more complementary gems 50 can be positioned to receive light losses 74 from primary gemstone 30 through crown 51 and return light 72 through crowns 51 to primary gemstone 30.

Returned light 72 can compensate for light loss 74 and even supplement the complementary light 72 with additional input into complementary gemstone 50 of ambient light 70. Similar complementary techniques can be used on brilliant cut primary gems 30 that suffer losses 74 from too shallow or too deep pavilions 40, for example.

The primary gem 30 and complementary gem 50 are envisioned to have mounting means fixedly positioning their alignment for the enhancement of the primary gem 30. Mounting means can include prongs or a lattice type structure, for example, or any other known mounting or setting means suitable for fixing the relative positions of the primary gem 30 and the at least one complementary gem 50.

Figure 4:
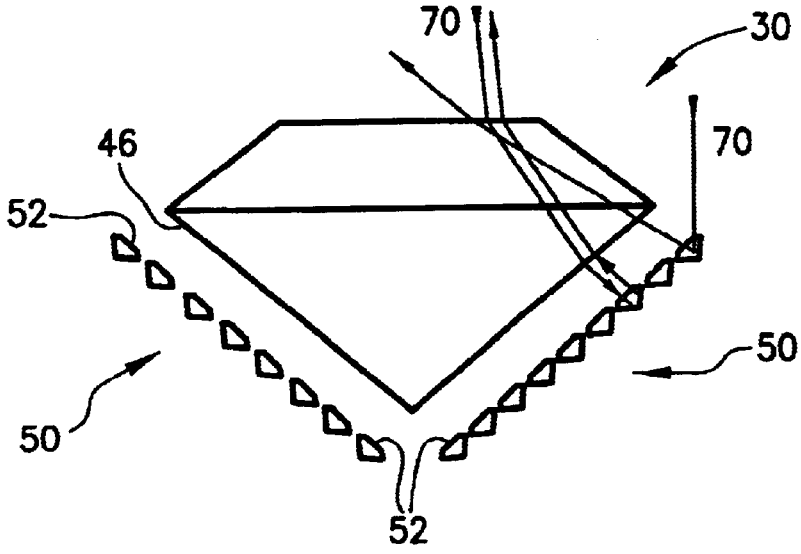
FIG. 4 is a cross-sectional side view of a second preferred embodiment of a gemstone arrangement wherein a plurality of gems are positioned as complimentary gems in combination with a primary gem as constructed in accordance with the present disclosure.

As shown in FIGS. 3–4, in a second preferred embodiment a plurality of complementary gems 50, substantially smaller than primary gem 30 are positioned in proximity to primary gem 30. The plurality of gems 50 can be positioned as isolated diamonds or groups of small individual diamonds such as a pave arrangement for example. The plurality of complementary gems 50 have their tables 52 aligned with the external wall 46 of the primary gem as previously described.

The plurality of gems 50 are arranged and aligned to receive ambient light 70 and pass light 72 in the direction of the primary gem. Similarly, the plurality of gems 50 are configured to receive light losses 74 and then return light 72 to the primary gem. Thus, while the scope of this disclosure relates to the orientation of tables 52 of complimentary gems 50 to external wall 46 of primary gem 30, the scope of this enclosure is intended to encompass a broad range of relative sizes of primary gem 30 and complimentary gems 50. It is also understood the relative sizes of primary gem 30 and complementary gems 50 and their respective tables 32 and 52 affect their individual visual characteristics and can be advantageously combined as described previously to create variety of visual enhanced characteristics of primary gem 30.

Although the illustrative embodiments of the percent disclosure have been described herein with reference to tie accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A gemstone arrangement comprising:

a primary gem comprising a brilliant cut diamond having a first table and a first pavilion, the first table defining a first center point and the first pavilion defining a first center point, the primary gem defining a longitudinal axis aligned with the first center point of the table and the first center point of the pavilion;

a plurality of at least four complementary gems comprising a brilliant cut diamond, each complimentary gem having a second crown and a second pavilion, the second crown defining a table, each complementary gem providing means for increasing the ambient light received by the primary gem;

the primary gem has a girdle and the first pavilion defines an external wall, a pavil angle being defined by the angle between the girdle and the external wall, the pavil angle being substantially parallel to the table of the nearest complimentary gemstone;

the table is positioned approximately parallel to the pavil angle of the primary gem;

the first pavilion includes a plurality of lower girdle facets and a plurality of pavilion facets, the table defining a flat planar face, the flat planar face on the complementary gem being positioned in juxtaposition with and parallel to one of the lower girdle facets or pavilion facets;

the means for increasing the amount of ambient light passing through the primary gem is the result of the positioning of each complementary gem to receive ambient light and pass the ambient light through the crown in the direction of the primary gem; and the means for increasing the amount of ambient light passing through the primary gem is the result of the positioning of at least one complementary gem to receive light losses from the primary gem and return at least a portion of the light losses through the second crown to the primary gem.

2. A gemstone arrangement comprising:

a primary gem having a first crown and a first pavilion, the first crown defining a first center point and the first pavilion defining a first center point, the primary gem defining a first longitudinal axis aligned with the first center point of the crown and the first center point of the pavilion;

a plurality of at least four complementary gems, each complementary gem having a table and a second pavilion, the table defining a second center point and the second pavilion defining a second center point, the second complimentary gem defining a second longitudinal axis aligned with the second center point of the table and the second center point of the pavilion, the complementary gem being positioned for passing light from the complementary gem in the general direction of the second longitudinal axis to the primary gem;

the primary gem is a brilliant cut diamond, each complimentary gem is a brilliant cut diamond;

the primary gem has a girdle and the pavilion of the primary gem defines an external wall, a pavil angle being defined by the angle between the girdle and external wall, the second longitudinal axis being perpendicular to the external wall and the table being substantially parallel to the table of the nearest complementary gemstone; and at least four complimentary gems are positioned such that the crown of the primary gem and the table of at least one of the complementary gems can receive light aligned with the first longitudinal axis.

* * * * *